United States Patent [19]

Schaller

[11] 4,015,501

[45] Apr. 5, 1977

[54] INJECTION MOLDED STICK FOR STRINGED MUSICAL INSTRUMENT BOW

[76] Inventor: Helmut F. K. Schaller, Kuckucksweg 16, 8501 Feucht, Germany

[22] Filed: Dec. 2, 1975

[21] Appl. No.: 637,106

[52] U.S. Cl. ..... 84/282

[51] Int. Cl.[2] ..... G10D 1/02

[58] Field of Search ..... 84/282, 422 S

[56] References Cited

UNITED STATES PATENTS

| | | | |
|---|---|---|---|
| 485,651 | 11/1892 | Perry | 84/282 |
| 2,466,834 | 4/1949 | Attwood | 84/282 |
| 2,730,001 | 1/1956 | Martin | 84/282 |
| 2,901,937 | 9/1959 | Galelli | 84/282 |
| 3,147,660 | 9/1964 | Brilhart | 84/422 S |
| 3,165,964 | 1/1965 | Stys et al. | 84/422 S |
| 3,456,544 | 7/1969 | Glasser | 84/282 |
| 3,489,052 | 1/1970 | Colyer et al. | 84/422 S |
| 3,722,350 | 3/1973 | Cordes | 84/422 S |

FOREIGN PATENTS OR APPLICATIONS

| | | | |
|---|---|---|---|
| 386,228 | 4/1908 | France | 84/282 |

*Primary Examiner*—Stephen J. Tomsky
*Attorney, Agent, or Firm*—McCormick, Paulding & Huber

[57] ABSTRACT

A stick for a violin or similar stringed instrument bow is made of a first body of injection molded plastic and a second body of a different strengthening material integrally fixed to the plastic body. The strengthening material or second body is designed for placement in a mold cavity prior to the injection of the plastic material of the first body, the plastic material upon injection engulfing the second body and filling the remaining empty space of the cavity to integrally fix the second body to the plastic body and to form a unitary finished bow stick. The combination of the two bodies provides a finished bow stick having weight, stiffness and other characteristics similar to that of a conventional wooden stick.

17 Claims, 6 Drawing Figures

INJECTION MOLDED STICK FOR STRINGED MUSICAL INSTRUMENT BOW

BACKGROUND OF THE INVENTION

This invention relates to bows for stringed musical instruments, and deals more particularly with a stick for such a bow capable of being made by a high volume, low unit cost plastic injection molding process.

Bow sticks for stringed musical instruments are conventionally made from wood, with pernambuco and mahogany being usually preferred varieties. The making requires a relatively large amount of manual labor and this, in addition to the cost of the raw material, causes the resulting sticks to be relatively expensive. For this reason, various attempts have been made in the past to fabricate bow sticks from various other materials, such as metals, plastics and fiberglass, enabling the sticks to be made at less expense, but these attempts have in general been unsuccessful.

The general object of this invention is to provide a bow stick for a stringed musical instrument made of relatively inexpensive materials and capable of being formed primarily through the use of a plastic injection molding process requiring little manual labor and, therefore, allowing large numbers of bow sticks to be made at small unit cost.

In keeping with the above object, a further object of the invention is to provide a bow stick of the aforesaid character which in addition to being susceptible to manufacture at low unit cost, has weight, stiffness and other characteristics giving it in general the appearance, feel and response of a high quality conventional wooden bow.

Other objects and advantages of the invention will be apparent from the following detailed description and from the drawings forming a part hereof.

SUMMARY OF THE INVENTION

Figures 1, 2, 3, 4, 5, 6:
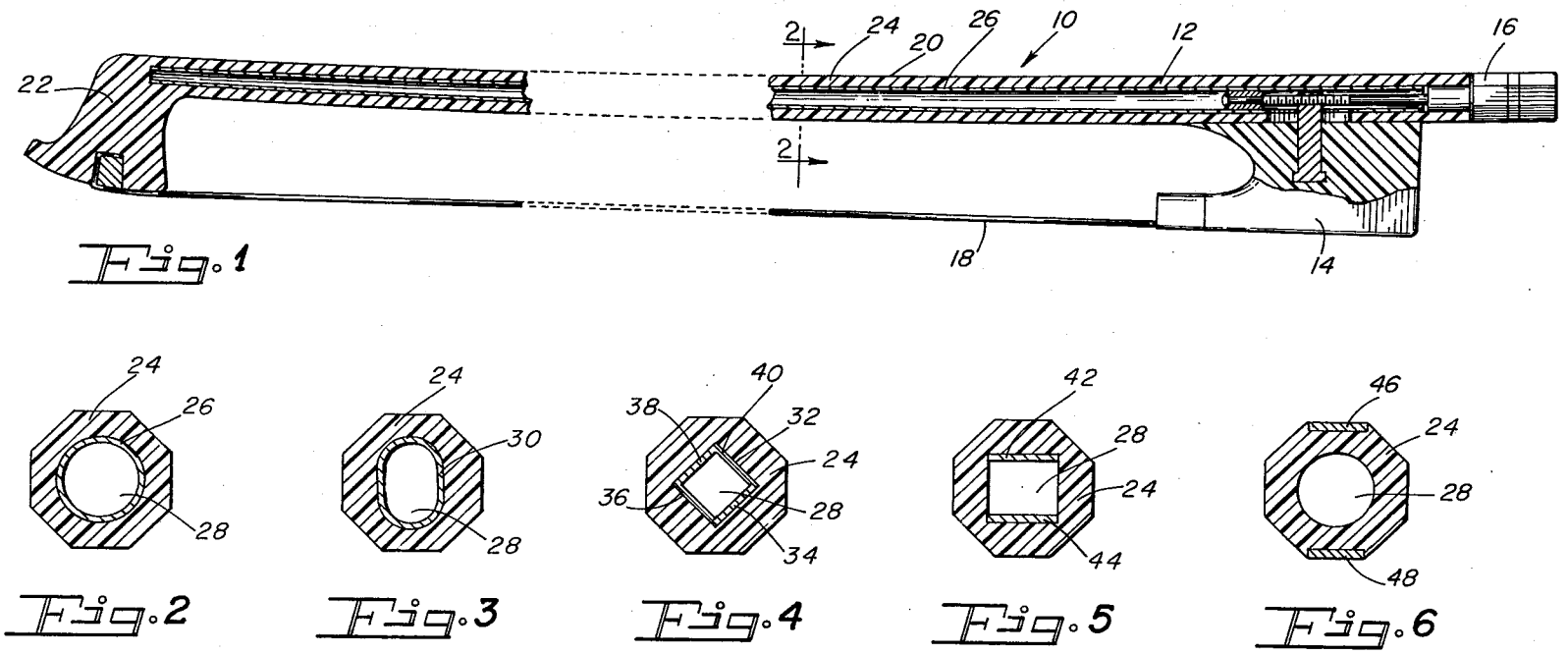
FIG. 1 is a fragmentary longitudinal sectional view taken through a violin bow made from a bow stick embodying the present invention.
FIG. 2 is a transverse sectional view taken on the line 2—2 of FIG. 1.
FIG. 3 is a transverse sectional view similar to FIG. 2 but showing an alternative embodiment of the invention.
FIG. 4 is a transverse sectional view similar to FIG. 2 but showing still another alternative embodiment of the invention.
FIG. 5 is a transverse sectional view similar to FIG. 2 but showing still another alternative embodiment of the invention.
FIG. 6 is a transverse sectional view similar to FIG. 2 but showing still another alternative embodiment of the invention.

The present invention resides in a stick for a violin or other similar stringed instrument bow designed for fabrication by an injection molding process and including, in addition to a first body of injection molded plastic, a second body of a different strengthening material fixed integrally to the injection molded body and providing the bow with a stiffness or rigidity factor similar to that of a conventional wooden bow. In particular, the stick includes an elongated shaft portion which along a major part of its length is made of a first body of plastic material and a second body of either a metal, such as an aluminum alloy, or of a composite material consisting of a plurality of high modulus of elasticity filaments, such as boron or graphite filaments, embedded in a resin matrix. The body of strengthening material is in the form of a plurality of elongated strips or a tube which may be placed in a mold cavity and later surrounded by the injection plastic of the first body to form the end product. The materials of the two bodies have specific gravities substantially greater than that of the wood conventionally used for bow sticks and the invention further resides in the bow stick having a hollow longitudinally extending bore of such a size that the resulting average specific gravity of the finished bow stick, including the volume of the hollow bore, is substantially the same as that of a conventional wooden bow.

DETAILED DESCRIPTION OF THE PREFERRED EMBODIMENTS

Referring to the drawings, and first considering FIGS. 1 and 2, a violin bow 10, as there shown, comprises a bow stick 12, a frog 14, a frog adjusting screw 16 and a set of hairs 18. The bow stick 12 in turn includes an elongated shaft portion 20 and a head portion 22 at one end of the shaft portion. The hairs 18 extend between the head 22 and the frog 14, and the frog 14 is adjustable along the length of the stick by rotation of the adjustment screw 16 to vary the tension of the hairs and the spacing of the hairs from the shaft portion 20. The manner of and means for attaching the hairs to the head 22 and to the frog 14, and the remaining construction of the frog 14 and of the adjustment screw 16 may be of a generally conventional nature and may be varied without departing from the invention. These features are, therefore, not described in detail.

In accordance with the present invention, the shaft portion 20 of the bow stick 12 is comprised of two different materials arranged in two different and separate bodies fixed integrally to one another. The first body is a body 24 of injection molded plastic which may be any desired one of a number of types of plastics commonly used for injection molding purposes such as nylon, polystyrene, ABS, polypropylene, PVC and the like. The second body is a strengthening body 26 which may either be made of a metal or of a composite material. If metal, it is preferably an aluminum alloy, or some other nonferrous metal, which is hardened and elastically springy. If a composite material, it consists of filaments, such as boron filaments or graphite filaments, having a high modulus of elasticity, embedded in a resin matrix, the filaments being arranged so as to extend parallel to the longitudinal axis of the stick shaft portion 20.

In the bow stick 12 of FIGS. 1 and 2, the strengthening body 26 is tubular and has a circular cross section, as seen best in FIG. 2, and it defines a hollow interior bore 28 for the shaft portion 24. Commonly, the wood of which bow sticks are conventionally made has a specific gravity within the range of 0.60 to 0.85, whereas the materials of the plastic body 24 and of the strengthening body 26 have substantially higher specific gravities. The bore 28 of the shaft is, therefore, designed to be of such a size that the average specific gravity of the bow stick, including the volume of the bore 28 is within the 0.60 to 0.85 range. For example, a violin bow of conventional construction commonly weighs between 58 to 65 grams including the bow stick, the hair, the frog and all other parts. Therefore, the size of the bore 28 is chosen so that the resulting bow stick has a weight sufficient to cause the complete bow, if a violin bow, to have a weight within the 58 to 65 gram range. Also, the material of which the plastic body 24 is made does not, by itself, have a modulus of elasticity and other characteristics giving it, if used by itself, a desirable stiffness. However, in the bow 12, the strengthening body 26 adds such stiffness and rigidity to the stick as to provide the bow with stiffness, feel and other characteristics similar to a conventional bow.

The construction of the bow 12 shown in FIGS. 1 and 2 is further one enabling the bow to be easily made by injection molding techniques. In the fabrication of such a bow, the strengthening body 26 is first formed as a separate rigid body. It is then placed in the cavity of a mold of an injection molding machine either by itself or with a mandrel inserted in its bore, the cavity of the mold being of the proper shape to define the outlines of the finished bow stick. The plastic material of the body 24 is then injected into the mold cavity and during this injection it engulfs the body 26 and otherwise fills the empty spaces of the mold cavity to both fix the body 26 integrally to the body 24 and to define the shape of the bow stick. If a mandrel is used to support the tubular strengthening body 26, it is, after the injection molding process, withdrawn from the molded bow stick, from the right-hand thereof, as viewed in FIG. 1 to leave the interior of the shaft portion 20 hollow.

The rigidity added to the bow stick by the strengthening body may be varied in a number of different ways to produce the desired amount of rigidity. For example, although in FIG. 1 the body 26 is shown to extend the full length of the shaft portion 20, it may, in some cases be designed to extend less than the full length of the shaft portion or may consist of axially spaced sections each extending along only a portion of the length of the shaft portion. Also, the thickness of the body may be varied to control the stiffening effect on the finished bow.

Another way for varying the stiffening influence of the strengthening body is to vary its cross-sectional shape and placement relative to the plastic body 24. FIGS. 3 to 6 show alternative embodiments of the invention wherein the strengthening body does have such other shape and placement. For convenience, in each of these figures, the plastic material body has been given the same reference number 24 as in FIGS. 1 and 2 and it will be understood that except for the differences in the shape and arrangement of the strengthening body the remaining structure of the bow stick is or may be the same as that of FIG. 1.

In the embodiment of FIG. 3, the strengthening body is indicated at 30 and has a generally oval shape as compared to the circular shape of the body 26 in FIG. 2. The longitudinal axis of the oval is oriented vertically when the bow stick is in the position of FIG. 1; and, therefore, this arrangement gives the shaft portion of the bow stick a greater resistance to bending in the direction of bend dictated by the hair tension than in the direction laterally of the bow hair.

In the embodiment of FIG. 4, the strengthening body is indicated at 32 and has a generally rectangular or square cross section. This body may be a single tubular part or may be made by laying up four strips 34, 36, 38 and 40 on a rectangular cross-sectioned mandrel prior to the placement of the strips and the mandrel into an injection mold cavity. In either case, it may be made either of a metal or of a composite material. In FIG. 4, the four sides of the strengthening body 32 are arranged so as to be inclined to the horizontal and vertical axes of the bow stick, but this is not necessary and, if desired, their arrangement may be such as to have two sides vertical and two sides horizontal.

In the embodiment of FIG. 5, the strengthening body consists of two strips 42 and 44 defining diametrically opposite faces of the hollow bore 28 of the bow stick. Again, in the fabrication of a bow stick in accordance with FIG. 5, the strips 42 and 44 of metal or composite material may conveniently be layed up on opposite faces of a square cross-section mandrel prior to the mandrel and the strips being placed in an injection mold cavity.

In each of the embodiments of FIGS. 1 to 5, the body of strengthening material is located adjacent the bore of the shaft portion of the bow stick so as to define all or part of the bore surface. This, however, is not necessary to the broader aspects of the invention, and if desired, the strengthening body may be located elsewhere relative to the injection molded plastic body 24. As an example of this, in the embodiment of FIG. 6, the strengthening body consists of two strips 46 and 48 of metal or composite material located adjacent and defining diametrically opposite exterior faces of the bow stick, the bow stick having an octagonal exterior shape in cross section. Preferably, the strips 46 and 48 are located at the top and bottom of the shaft portion 20 when the resulting bow is oriented as in FIG. 1, so as to have maximum resistance on bending of the bow in the direction caused by tensioning of the bow hair.

I claim;

1. A bow stick for a stringed musical instrument bow, said stick comprising an elongated shaft portion and a head portion at one end of said shaft portion, said head portion being adapted to receive and hold one end of a set of hairs extending from said head portion to a frog carried by the other end of said shaft portion, said shaft portion along at least a major part of its length having a hollow longitudinally extending interior bore and being made of two different materials located in two different zones in a transverse cross section through said shaft portion, one of said materials being a strengthening material and the other of said materials being a moldable plastic material molded to said strengthening material so as to integrally fix said two materials to one another, said head portion of said stick being molded of the same plastic material as, and being of one piece with, said plastic material of said stick portion.

2. A bow stick for a stringed musical instrument as defined in claim 1 further characterized by said strengthening material being a metal.

3. A bow stick for a stringed musical instrument as defined in claim 2 further characterized by said metal being an aluminium alloy.

4. A bow stock for a stringed musical instrument as defined in claim 1 further characterized by said strengthening material being a composite material.

5. A bow stick for a stringed musical instrument bow, said stick comprising an elongated shaft portion and a head portion at one end of said shaft portion, said head portion being adapted to receive and hold one end of a set of hairs extending from said head portion to a frog carried by the other end of said shaft portion, said shaft portion along a major portion of its length having a hollow longitudinally extending interior bore and consisting of a first body of molded plastic material and a second body of a different strengthening material integrally fixed relative to said first body of plastic material, said head portion being made of molded plastic material and being of one piece with and of the same material as said first body of plastic material constituting part of said shaft portion.

6. A bow stick for a stringed musical instrument bow as defined in claim 5 further characterized by said strengthening material being a metal.

7. A bow stick for a stringed musical instrument bow as defined in claim 5 further characterized by said strengthening material being a composite material consisting of a plurality of filaments embedded in a resin matrix.

8. A bow stick for a stringed musical instrument bow as defined in claim 7 further characterized by said filaments being parallel to the longitudinal axis of said shaft portion of said bow stick.

9. A bow stick for a stringed musical instrument bow as defined in claim 7 further characterized by said filaments being selected from the class consisting of graphite filaments and boron filaments.

10. A bow stick for a stringed musical instrument bow as defined in claim 5 further characterized by said strengthening material of said second body and said plastic material of said first body having specific gravities greater than 0.80, said bow stick being so designed that its average specific gravity, including the volume of its hollow bore, is within the range of 0.60 to 0.85.

11. A bow stick for a stringed musical instrument bow as defined in claim 5 further characterized by said hollow longitudinally extending bore being of rectangular cross section, said body of strengthening material comprising two strips of such material located adjacent and defining opposite faces of said bore.

12. A bow stick for a stringed musical instrument bow as defined in claim 5 further characterized by said hollow longitudinally extending bore being of rectangular cross section, said body of strengthening material comprising four strips of such material respectively located adjacent and defining the four faces of said bore.

13. A bow stick for a stringed musical instrument bow as defined in claim 5 further characterized by said body of strengthening material being tubular and extending around the full circumference of and defining the surface of said bore.

14. A bow stick for a stringed musical instrument as defined in claim 5 further characterized by said body of strengthening material being at least one strip of such material located adjacent the outer surface of said shaft portion of said bow stick.

15. A bow stick as defined in claim 5 further characterized by said body of strengthening material comprising two strips of such material located adjacent the outer surface of said shaft portion and located on diametrically opposite sides of said shaft portion from one another.

16. A bow stick for a stringed musical instrument bow, said stick including a shaft portion comprised of an elongated hollow tube of strengthening material and an outside shell of moldable plastic material made by molding said plastic material about said tube so that said tube and shell are integrally fixed to one another, said stick also including a molded head portion at one end of said shaft portion adapted to receive and hold one end of a set of hairs extending from said head portion to a frog carried by the other end of said shaft portion, said head portion being comprised of moldable plastic material and being of one piece with said moldable plastic material of said shaft portion.

17. A bow stick as defined in claim 16 further characterized by the tube of strengthening material being made of a non-ferrous metal.

* * * * *